United States Patent [19]

Cardinale et al.

[11] Patent Number: 4,909,418

[45] Date of Patent: Mar. 20, 1990

[54] RIVET SET

[75] Inventors: Peter D. Cardinale, East Meadow; Ottavio Giannuzzi, Baldwin, both of N.Y.

[73] Assignee: Grumman Aerospace Corporation, Bethpage, N.Y.

[21] Appl. No.: 322,861

[22] Filed: Mar. 14, 1989

[51] Int. Cl.[4] ..... B25C 7/00

[52] U.S. Cl. ..... 227/112; 227/149

[58] Field of Search ..... 227/112, 149

[56] References Cited

U.S. PATENT DOCUMENTS

| | | | |
|---|---|---|---|
| 380,645 | 4/1888 | Dean | 227/112 |
| 1,400,002 | 12/1921 | Roger | 227/112 |
| 3,521,398 | 7/1970 | Coutts | 227/149 |
| 3,695,461 | 10/1972 | Ginther | 294/64.1 |
| 3,816,895 | 6/1974 | Kuehn et al. | 227/149 X |
| 4,135,630 | 1/1979 | Snyder et al. | 29/740 |
| 4,305,540 | 12/1981 | Olson | 227/61 |
| 4,346,514 | 8/1982 | Makizawa et al. | 29/740 |
| 4,392,300 | 7/1983 | Billman et al. | 227/112 X |
| 4,548,396 | 10/1985 | Nelen | 271/90 |
| 4,609,134 | 9/1986 | Davern | 227/112 |
| 4,736,880 | 4/1988 | Sodeno | 227/149 |

*Primary Examiner*—Timothy V. Eley
*Assistant Examiner*—Frances Chin
*Attorney, Agent, or Firm*—Pollock, VandeSande & Priddy

[57] ABSTRACT

A riveting tool incorporates both rivet grasping and rivet driving means in a single tool. A resilient rivet retaining skirt is mounted to the driving means and the skirt interior is provided with pressure to ensure retention of the rivet. After the rivet is partially inserted into a hole, a driving surface of the tool forces the rivet out of engagement with the skirt for full insertion into the hole and riveting may then be completed.

6 Claims, 1 Drawing Sheet

RIVET SET

FIELD OF THE INVENTION

The present invention relates to automated means for setting rivets, and more particularly to such a means for holding and inserting a rivet during the fabrication of a device.

BACKGROUND OF THE INVENTION

It is now prevalent to utilize automated machines for inserting fasteners, such as rivets, in structural members. In the aircraft industry rivets are used extensively in the construction of an air frame.

Typically, riveting procedures require a rivet set, a tool for inserting and holding a rivet within a hole while the tail portion is deformed to secure the rivet in place.

Prior art procedures and structures have required separate manual or tool holding and inserting of the rivet.

BRIEF DESCRIPTION OF THE PRESENT INVENTION

The present rivet set includes a resilient skirt member, attached to a rivet driving tool, which enables the tool to hold a rivet while it is moved into a hole thereby eliminating separate tools for moving and holding the rivet.

The rivet set of the present invention is designed to be used with commercially available system which is capable of producing the necessary static head to enable a rivet holding skirt to securely hold the rivet in place. The rivet set can be interfaced with either manual or automated riveting equipment and may also be mounted to a robotic arm. The design is unique in that it can pick up, hold and squeeze the rivet in one motion. Since all these functions can be accomplished with a single tool, an increase in production and cost savings can be realized. The rivet set itself can be fabricated from standard tooling material.

BRIEF DESCRIPTION OF THE FIGURES

The above-mentioned objects and advantages of the present invention will be more clearly understood when considered in conjuction with the accompanying drawings, in which.

DETAILED DESCRIPTION OF THE INVENTION

Figure 1:
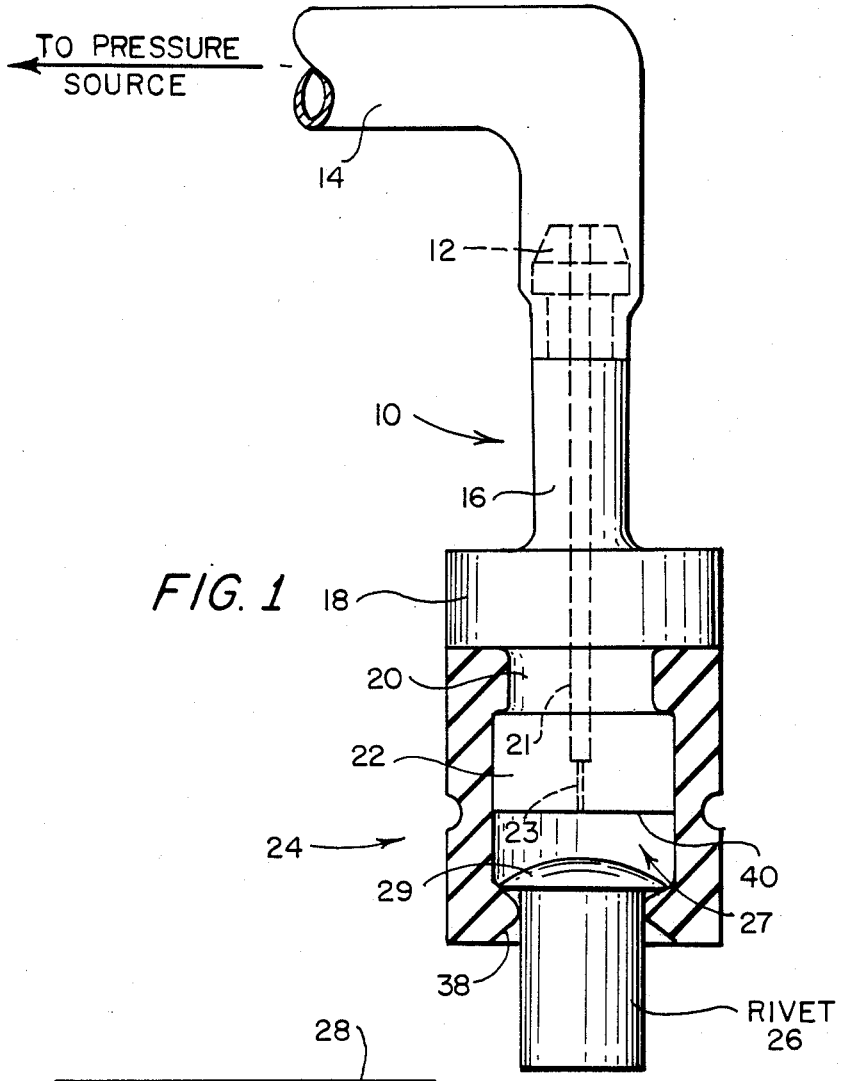
FIG. 1 is a partial cut-away view of the present rivet set illustrating a held rivet therein.

Reference numeral 10 generally indicates a first principal part of the present rivet set which holds and drives a rivet into a hole. Reference numeral 24 indicates the second principal part of the present invention, namely a resilient skirt, preferably fabricated from an elastomeric material. As seen in FIG. 1, the skirt 24 secures a rivet 26 to the illustrated rivet set.

The rivet driver 10 includes a hollowed tapered step-down fitting 12 to which is mounted the first end of an elastomeric tube 14. The opposite end of the tube 14 is connected to a pressure source (not shown). The purpose of the pressure source is to create a holding force on rivet 26, as will be explained hereinafter.

The fitting 12 extends to an elongated stem 16 which is, in turn, axially integrally connected to a cylindrical shoulder 18.

Figure 2:
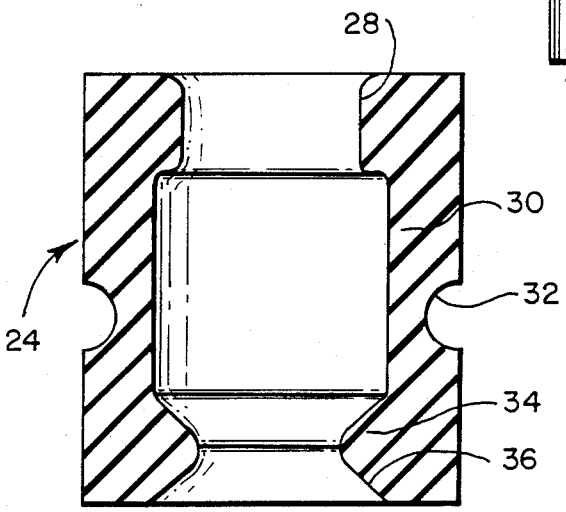
FIG. 2 is a cross-sectional view of the resilient skirt which is employed in connection with the present invention.

The shoulder 18 axially extends to a neck section 20 of the driver 10. A cylindrical head or anvil section 22 extends axially from the neck section 20. An axially extending bore 21 communicates with a coaxially communicating bore 23, the latter located exclusively within the head 22. The purpose of the axially extending bores 21 and 23 is to communicate the static head present at tube 14 to the chamber volume 27 created between the driver head 22 and the head 29 of rivet 26. The skirt 24 includes a shoulder portion 28 as shown in FIG. 2. This shoulder portion 28 resiliently engages the neck section 20 of driver 10. This retains the skirt 24 to the driver 10 during two basic operations of the rivet set. The first operation being the retention of rivet 26 within the skirt 24 from a rivet pick-up point to a rivet deposit point and during a second operation wherein head 22 of the driver 10 contacts the rivet 26 in preparation of rivet securement within a panel (not shown) in conventional fashion. Again referring to FIG. 2, the skirt 24 is seen to further include a cylindrical section 30 which receives the head 22 (FIG. 1) of the driver 10.

In order to increase the compliance of the resilient skirt 24 during a driving operation, an annular indentation 32 is formed within the intermediate cylindrical section 30. This annular indentation increases skirt compliance and ensures successful precise insertion of a rivet into a hole. Surface 40 of head 22 contacts the oppositely disposed head 29 of rivet 26 to push the rivet completely into the hole.

Skirt 24 is also characterized by a lower annular inwardly projecting section 34 which serves to grip the head and shank sections of rivet 26 as shown in FIG. 1. The lower surface of projecting section 34 is characterized as a frusto-conical surface 36 which is large enough to permit forced initial entry and securement of the rivet head within the skirt as shown by 38.

In operation of the rivet set shown in FIG. 1, the rivet set driver 10 is moved, either manually or automatically, to engage a rivet 26. After the driver 10 is moved to a workpiece, it is moved toward a hole therein until rivet 26 is inserted within the hole. In order to complete a conventional riveting cycle, the head 22 is moved downwardly toward the hole thereby forcing the surface 40 to contact rivet head 29 and push the rivet out from the skirt 24 and completely into the hole. The head 22 maintains contact with the rivet until a means (not shown) deforms the tail portion of the rivet to secure it in place, thereby completing rivet fastening.

It is to be understood that, although one form of rivet is illustrated in FIG. 1, the present invention is intended to operate satisfactorily with a wide range of rivet configurations. Further, although the present invention is illustrated as being operable with a rivet, it is to be understood that other types of fasteners may be used wherein initial holding of the fastener is desired, followed by continued holding during completion of a fastening operation.

It should be understood that the invention is not limited to the exact details of construction shown and described herein, for obvious modifications will occur to persons skilled in the art.

We claim:

1. A fastener tool comprising:

a main driving member having a fastener driving surface; and a single piece resilient skirt positioned over the driving member and interlocked therewith, the skirt further including projection means integrally formed in the skirt for resiliently and removably retaining a fastener while the tool and fastener move between two points;

wherein the skirt resiliently yields when the driving surface forces the fastener out of the skirt.

2. The structure set forth in claim 1 together with a pressure source communicating with the fastener while it is retained by the skirt for ensuring continued retention of the fastener by the skirt before completion of the fastener operation.

3. The structure set forth in claim 2 together with an annular groove formed in the skirt for allowing the skirt to flex during positioning of the fastener into a hole.

4. A rivet tool comprising:

a main rivet tool member having a surface for contacting a rivet;

a resilient skirt mounted to the main tool member;

interior projection means integrally formed in the skirt for resiliently and removably retaining a rivet;

passage means formed in the main rivet tool member for communicating a pressure from an external source to the interior of the skirt for forcing the rivet into continued engagement with the skirt until riveting is completed;

a driving head formed in the main tool member and having the rivet contacting surface for driving the rivet out from the skirt after the rivet has been partially inserted in a hole; and annular indentation means formed in the main rivet tool member for resiliently interlocking a mating annular enlargement integrally formed in the skirt.

5. The structure set forth in claim 4 together with coupling means formed in the main tool member for receiving a pressure tube.

6. The structure set forth in claim 5 together with an annular groove formed in the skirt for allowing the skirt to flex during positioning of the fastener into a hole.

* * * * *